United States Patent [19]

Buryta

[11] Patent Number: 4,823,671

[45] Date of Patent: Apr. 25, 1989

[54] DEVICE FOR MANUALLY RECOILING SLIDE ACTION PISTOLS

[76] Inventor: Frank Buryta, 875 Pioneer Dr., North Tonawanda, N.Y. 14120

[21] Appl. No.: 123,265

[22] Filed: Nov. 20, 1987

[51] Int. Cl.[4] ..... F41C 27/00; F41D 11/00

[52] U.S. Cl. ..... 89/1.4; 42/106

[58] Field of Search ..... 89/1.4; 42/106

[56] References Cited

U.S. PATENT DOCUMENTS

| | | | |
|---|---|---|---|
| 3,651,736 | 3/1972 | Ingram | 89/1.4 |
| 4,043,065 | 8/1977 | Musgrave | 42/106 |
| 4,055,015 | 10/1977 | Musgrave | 42/106 |
| 4,555,973 | 12/1985 | Timari | 89/114 |
| 4,565,113 | 1/1986 | Bunning | 89/1.4 |
| 4,702,144 | 10/1987 | Zedrosser | 89/1.4 |

OTHER PUBLICATIONS

"The Colt Cocker", in the *Shooting Times,* May, 1987, p. 59.

*Primary Examiner*—David H. Brown

[57] ABSTRACT

The present invention relates to a slide back device which is particularly adapted to use on pistols having a scope mounted atop the pistol. The present device allows the shooter to manually recoil slide action weapons using a simple pull back motion easily carried out with one hand leaving the operator's other hand free to maintain a firm grip on the pistol handle. The manual recoil action is carried out without the operator placing his arm or hand over the muzzle of the weapon. The present device consists of an engaging, or receiving, plate having an opening therein to receive the muzzle of a slide action weapon. The opening is sufficiently large to pass the barrel portion of the weapon, but insufficiently large to pass the slide member. Thus the engaging plate passes the gun barrel therethrough, but engages the front, or forward, portion of the pistol slide member. The perforated engaging plate has at least one planar side extention which has a handle extending therefrom. In use the engaging plate is placed over the muzzle of a pistol and the opening in the plate aligned with the muzzle. The operator grasps the handle on the device and pulls the handle toward the rear of the pistol. As the device is pulled rearward, the muzzle and barrel pass through the perforation in the engaging plate and the front portion of the pistol slide member engages the engaging plate, which, in turn, moves the slide member backward, manually recoiling the pistol.

6 Claims, 2 Drawing Sheets

DEVICE FOR MANUALLY RECOILING SLIDE ACTION PISTOLS

BACKGROUND AND PRIOR ART

The present invention relates to devices for manually recoiling slide action handguns, that is, moving the slide member on such weapons from a forward to a rearward position. More particularly, the present invention provides a means for safely manually recoiling slide action pistols having scopes mounted thereon.

Automatic or semiautomatic pistols are typically loaded by insertion of a magazine, or clip, into a receiving chamber, usually located in the pistol grip or handle. The topmost cartridge is subsequently mechanically moved from the magazine into the firing chamber. Typically movement of the cartridge into the firing chamber is initiated by the operator manually recoiling the weapon. Such manipulation is also commonly utilized to initiate other actions, for example, cocking of the firing hammer. Placement of a cartridge in the firing chamber is called charging.

The present invention is particularly adapted to slide action pistols. Such pistols have a recoiling slide member which reciprocates over a stationary frame member. When the slide member is positioned in a forward position, it surrounds, or substantially surrounds, the top and sides of the pistol barrel except for the muzzle portion. When the weapon is fired, the slide member recoils to expose a substantial portion of the barrel. Typically the pistol barrel recoils slightly, or not at all. Such weapons are initially charged by manually recoiling and releasing the slide member to cause mechanical engagement of the topmost cartridge in the magazine and mechanically move the cartridge into the firing chamber. A manual recoil, or slide back, action is utilized in case of a misfire, e.g., when a defective cartridge, or a cartridge casing, must be removed from the firing chamber. A manual recoil action is also carried out in case of jams, e.g., where a cartridge, or cartridge casing, is caught in the receiving area of the firing chamber, or in the ejection port. A slide action is also carried out when the weapon is unloaded, e.g., where a live round is removed from the firing chamber.

A manual recoil, or slide back, action is most safely carried out while the weapon is maintained in a direction away from both the operator and other people. In carrying out the operation, the operator firmly grips the slide member and with a pulling action towards his person moves the slide member to a rearward position on the pistol frame. Slide action type pistols may also be manipulated by the highly undesirable practice of the operator placing his hand in front of the muzzle and pushing the slide member to a rearward position. In such case the operator's arm or hand is positioned over the muzzle and is dangerously exposed to injury in case of an accidental firing of the weapon during recoil. Since the advent of pistols equipped with scopes, especially those equipped with pistol-grip type scopes, such danger has been greatly increased because the presence of the scope and the scope attachments minimizes, or substantially eliminates, the effective use of the normal gripping area typically located on the slide member. The presence of a scope also interfers with the operator's ability to directly pull the slide member to a rearward postion while controlling the direction in which the weapon is pointed and is in many cases involving pistols with scopes, the operator foolishly finds it more convienent to place his hand over the muzzle of the scope-equipped weapon and manually recoil the weapon by pushing the slide member rearward.

The present manual recoil device, or slide back tool, allows the operator to safely and convieniently manulipulate the slide member on a slide action type handgun without placing his hand over the muzzle of the weapon.

It has previously been proposed to charge slide action weapons by devices external the the weapon. For example, U.S. Pat. No. 4,043,065 teaches a mounted socket which receives the muzzle of a pistol and the weapon charged by pushing the barrel of the weapon through the socket. U.S. Pat. No. 4,055,015 describes a holster charging device in which a ratchet means is used to hold the pistol slide member stationary while the weapon is charged by moving the weapon further into the holster. These references are the most relevant prior art relating to the present invention to which applicant is presently aware.

BRIEF DESCRIPTION OF THE INVENTION

The slide back device of the present invention is particularly adapted to use on automatic or semiautomatic pistols having a scope mounted atop the pistol, and more particularly to, such pistols having a pistol-grip type scope mounted thereon. The present device is a tool that is easily portable either on the person, or among the usual equipment found in a shooters kit. The present device allows the operator to manually recoil slide action weapons using a simple pull back motion which can be easily carried out with one hand leaving the operator's other hand free to maintain a firm grip on the pistol handle. The manual recoil action is carried out without the operator placing his arm or hand over, or in the close proximity to, the muzzle of the weapon. The present device consists of an engaging, or receiving, plate having an opening therein to receive the muzzle of a slide action weapon. The opening is sufficiently large to pass the barrel portion of the weapon, but insufficiently large to pass the slide member. Thus the engaging plate passes the gun barrel therethrough, but engages the front, or forward, portion of the pistol slide member. The perforated engaging plate has at least one planar side extention, extending at an angle of substantially 90 degrees therefrom. The side extention has an outwardly extending handle mounted thereon, extending at an angle of substantially 90 degrees thereto, and substantially parallel to the plane of the engaging plate.

In use the engaging plate is placed over the muzzle of a pistol and the opening in the plate aligned with the muzzle. The operator grasps the handle on the device and pulls the handle toward the rear of the pistol, and preferably, for safety reasons, also toward the operator. As the device is pulled rearward, the muzzle and barrel pass through the perforation in the engaging plate and the front portion of the pistol slide member engages the engaging plate, which, in turn, moves the slide member backward, manually recoiling the pistol.

DETAILED DESCRIPTION OF THE INVENTION

The present invention will now be described in greater detail in preferred embodiments by reference to the accompanying drawings in which similar components are identified by like numbers in each of the views.

Figure 1:
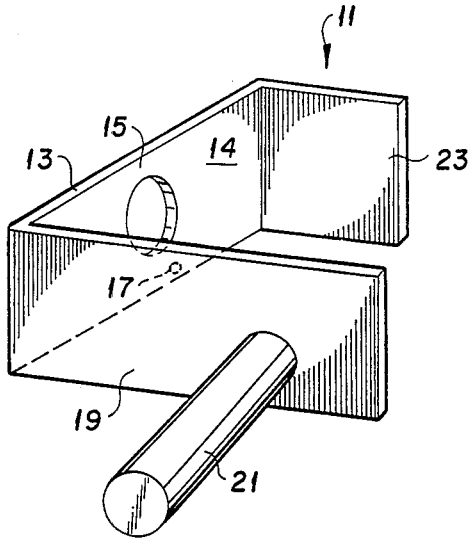
FIG. 1 is a perspective view of the present manual recoil, or slide back, device.

Looking now in detail at FIG. 1, the present slide back device, or tool, is generally indicated as 11. Tool 11 has a front, substantially planar, engaging plate 13. Engaging plate 13 has a generally annular opening, or perforation, 15 therein. Preferably, and typically, opening 15 is substantially centered in plate 13. Opening 15 is of a size that will recveive and pass therethrough the muzzle and barrel of the slide action pistol. Engaging plate 13 may also have additional auxiliary openings, such as, 17, to receive and freely pass through guides or other protrubrances that may be present in structure in the front portion of a particular type of pistol. While opening 15 is sufficiently large to receive and freely pass therethrough the pistol muzzle and barrel, opening 15 is sufficiently small that it will not pass the pistol slide member therethrough. In this manner perforated engaging plate 13 would receive and pass the muzzle and barrel portions of a slide action pistol, but would engage the front portion of the slide member by contact along contact surface 14. Contact surface 14 may suitably be coated with a plastic or rubber material to provide a non-scratching contact surface.

Engaging plate 13 has a relatively elongated, substantially planar side extention 19 extending perpendicular therefrom. Extention 19 has a handle, such as 21 outwardly mounted thereon. Handle 21 is preferably of a size to be grasped by at least two fingers. Engaging plate 13 and side portion 19 are preferably substantially the same width and join at an angle of substantially 90 degrees and handle 21 extends from side portion 19 at an angle of substantially 90 degrees.

In a particularly preferred embodiment, which facilitates easy placement of the device over the muzzle of a weapon with a minimum need for the operator to place his head close to the muzzle to visually check the alignment, engaging plate 13 has a second, substantially planar side extention 23, positioned opposite extention 19. Preferably extention 23 is substantially the same width as engaging plate 13, and suitably is of a substantially lesser length than extention 19.

Figure 2:
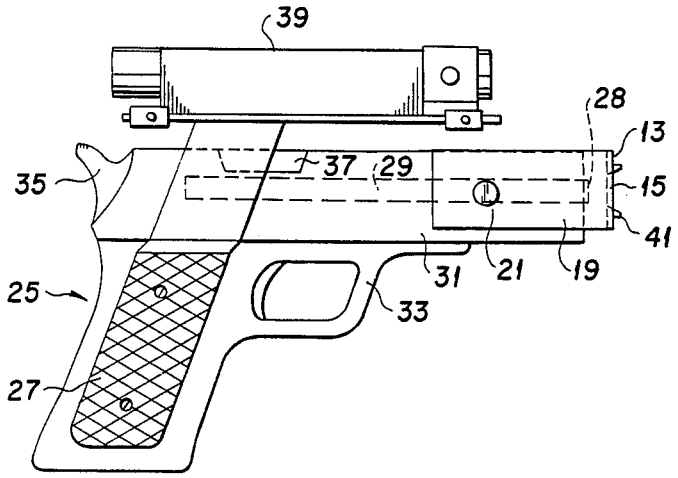
FIG. 2 is a frontal view showing the present device as positioned over the muzzle of a pistol.

FIG. 2 illustrates the present slide back device 11 as it would be positioned over the muzzle of a slide action type pistol, 25 in preparation to moving the slide member to a rearward position. The pistol as shown is a typical slide action pistol and does not represent any specific, or particular, make or model. As depicted, pistol 25 has a grip 27, a barrel 29, a slide member 31, a frame 33, a hammer 35, an ejection port 37, and a pistol grip scope 39. The slide back device is positioned over the muzzle 28 of barrel 29 so that opening 15 in engaging plate 13 is located directly over barrel 29. Opening 15 may be tapered, or turned, outward and may have an outward extention such as, 41, to facilitate alignment and entry of the gun barrel therethrough. It will be noted that the present slide back device may be positioned on the pistol so that handle 21 is adapted to use with either hand by merely positioning the device on the desired side of the weapon.

Figure 3:
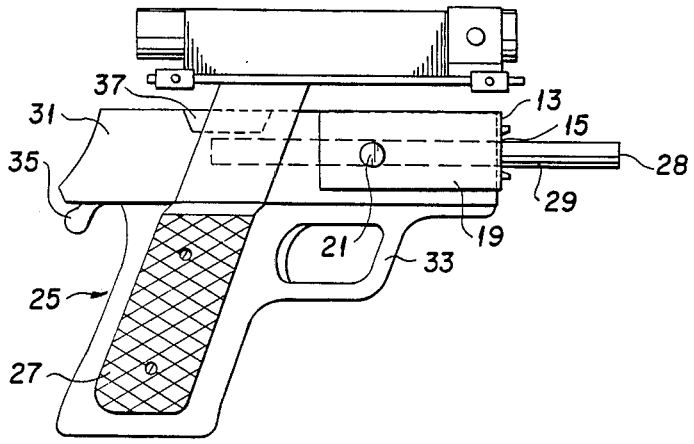
FIG. 3 is a frontal view showing the present device as it would be utilized to engage and move the slide member of a pistol to a rearward position.

FIG. 3 shows slide member 31 on pistol 25 in a rearward position as it would be if the operator had engaged the device and pulled handle 21 which in turn would move the pistol slide member toward the rear of the pistol.

The present manual recoiling device may suitably be fabricated of any materials that are dimensionally stable and will withstand the required repeated pulling action without bending or otherwise becoming distorted. For example, the device may be fabricated of metals, such as, steel, brass, or copper alloys, or of plastics such, such as, polypropylene. In one preferred embodiment, the device has a layer of plastic along its inner portion to protect the pistol from being marred or scratched. Preferably the edges and corners of the device are rounded to eliminate snagging and facilitate ease of handling and aligning.

It will be understood that the dimensions of the present device may be easily and suitedly adjusted to various sizes and models of slide action pistols. In typical use the face member ranges between about 1 and about 1½ inches square, the side extention with the handle between about 2 and about 3 inches in length, and the second side member between about 1 and 1½ inches in length. The handle ranges from about a two finger width (2 inches) to about a hand width (4 inches).

While the present invention has been illustrated in connection with a preferred embodiment, it will be understood that various modifications and alteration will occur to those skilled in the art. Therefore, it is not desired that the invention be limited to the details of construction that are illustrated and described herein. It is intended by the appended claims to cover all modifications or alternatives which fall within the spirit and scope of the invention.

What is claimed is:

1. A slide back device for manually recoiling the slide member on a slide action type pistol comprising:

a. a front engaging plate, said plate having an opening therein, said opening being sufficiently large to receive the muzzle portion of a pistol barrel and pass the pistol barrel therethrough, said opening being sufficiently small not to pass the slide member of the pistol, said plate having a contact surface for engaging the front portion of a pistol slide member, b. a side extention extending perpendicular from said engaging plate, and c. said extention having a gripping handle mounted thereon and extending outward substantially perpendicular thereto.

2. The slide back device of claim 1 wherein said opening in said engaging plate is tapered outward toward the front of the device.

3. The slide back device of claim 1 wherein the device is fabricated of metal, or plasic, or mixtures thereof.

4. The slide back device of claim 1 wherein the device is fabricated of a metal.

5. The slide back device of claim 1 wherein the engaging plate has a second side extention thereto positioned at the end opposite said first side extention, said second extention extending substantially perpendicular from said engaging plate.

6. The slide back device of claim 5 wherein the first side extention is longer in length that said second side extention.

* * * * *